US012313064B2

(12) United States Patent
Beck et al.

(10) Patent No.: US 12,313,064 B2
(45) Date of Patent: May 27, 2025

(54) RECIPROCATING PUMP TURNING AND BARRING TOOL

(71) Applicant: EKU Power Drives GMBH, Spring, TX (US)

(72) Inventors: Levi Wayne Beck, Spring, TX (US); Lothar Bloschies, Spring, TX (US)

(73) Assignee: EKU POWER DRIVES GMBH, Spring, TX (US)

( * ) Notice: Subject to any disclaimer, the term of this patent is extended or adjusted under 35 U.S.C. 154(b) by 280 days.

(21) Appl. No.: 17/941,969

(22) Filed: Sep. 9, 2022

(65) Prior Publication Data

US 2024/0052817 A1 Feb. 15, 2024

Related U.S. Application Data

(60) Provisional application No. 63/398,215, filed on Aug. 15, 2022.

(51) Int. Cl.
*F04B 9/04* (2006.01)
*F01B 9/04* (2006.01)

(52) U.S. Cl.
CPC ..... *F04B 9/047* (2013.01); *F01B 9/047* (2013.01)

(58) Field of Classification Search
USPC ..... 192/48.1, 56.3
See application file for complete search history.

(56) References Cited

U.S. PATENT DOCUMENTS 398,999 A * 3/1889 Barnard ..... B65B 57/06 141/195
462,192 A * 10/1891 Barnard ..... F16D 13/26 192/99 S
1,260,195 A * 3/1918 Williams ..... F16H 1/32 192/21

(Continued)

FOREIGN PATENT DOCUMENTS

DE 102016124369 A 6/2018

OTHER PUBLICATIONS

Amazon sales page for a pinion pulley (retrieved Aug. 1, 2024 from https://www.amazon.com/10T-5mm-Timing-Pinion-Pulley/dp/B00S6LIXF4) (Year: 2024).*

(Continued)

*Primary Examiner* — Bryan M Lettman
*Assistant Examiner* — Geoffrey S Lee
(74) *Attorney, Agent, or Firm* — Lathrop GPM LLP

(57) ABSTRACT

A tool includes a core ring including a first end and an opposing second end. An opening is defined through the first and second ends. The core ring includes a first radial engagement component. The tool also includes a pin including a shaft having first and second sides. The first side of the shaft is disposed at least adjacent the opening of the core ring. The pin further comprises a second radial engagement component configured to engage with the first radial engagement component of the core ring. The second side of the shaft extends axially outwardly from the second end of the core ring. The tool also includes a sleeve connected to the core ring. The first side of the shaft of the pin is slidable with respect to the sleeve. At least a portion of the sleeve extends axially outwardly from the first side of the core ring.

18 Claims, 7 Drawing Sheets

(56) References Cited

U.S. PATENT DOCUMENTS 1,634,063 A * 6/1927 Ahlm ..... F16H 3/70 475/303
1,868,254 A * 7/1932 Reaves ..... F16D 23/10 192/48.1
1,955,200 A * 4/1934 Millican ..... F16D 41/00 74/576
2,684,741 A * 7/1954 Gregory ..... F16D 11/10 192/109 R
2,921,483 A * 1/1960 Colmerauer ..... F16D 31/04 475/108
4,580,534 A * 4/1986 Blum ..... F02F 7/0046 74/625
5,460,138 A * 10/1995 Hasegawa ..... F02B 77/00 123/198 R
5,882,181 A * 3/1999 Genter ..... F01B 27/08 417/364
5,950,509 A 9/1999 Lin
6,007,303 A * 12/1999 Schmidt ..... H02K 49/108 123/41.47
6,230,819 B1 * 5/2001 Chen ..... B25F 5/001 173/48
8,317,007 B2 * 11/2012 Su ..... F16D 43/286 192/56.3
10,400,669 B2 * 9/2019 Liu ..... F02N 11/101
2011/0198887 A1 * 8/2011 Rabhi ..... F04B 35/002 91/462
2014/0093399 A1 * 4/2014 Pratelli ..... F04B 35/00 417/319
2015/0337906 A1 * 11/2015 Archan ..... F16D 11/06 192/71
2016/0375528 A1 * 12/2016 Pawlicki ..... F02N 15/06 29/888.011
2024/0052817 A1 * 2/2024 Beck ..... F01B 9/047

OTHER PUBLICATIONS

International Search Report and Written Opinion for Application No. PCT/US2023/030171, filed on Aug. 14, 2023, 1 document mailed Feb. 8, 2024, 7 pages.

* cited by examiner

RECIPROCATING PUMP TURNING AND BARRING TOOL

RELATED APPLICATIONS

This application claims priority to U.S. Provisional Patent Application 63/398,215, filed Aug. 15, 2022, the entirety of which is hereby incorporated by reference.

BACKGROUND

Reciprocating pumps are used during production in the oil and gas industry. A reciprocating pump may be turned over by hand during maintenance. Turning a reciprocating pump by hand may be performed using a pry bar or large pipe placed in the input drive shaft U-joint of the reciprocating pump.

However, using a pry bar or pipe may increase the risk of shearing off a drive line grease tip of the reciprocating pump, thereby rendering the U-joint unable to be greased. In such an event, the U-joint and hub are decoupled from the pump and a grease zerk (a component designed to keep grease within the reciprocating pump) is replaced. However, the reciprocating pump is not performing its primary function during the additional maintenance, thereby costing time or money in during oil production. Furthermore, the U-joint may not be properly lubricated.

SUMMARY

The one or more embodiments provide for a tool. The tool includes a core ring including a first end and a second end disposed opposite the first end. An opening is defined through the first end and the second end. The core ring includes a first radial engagement component. The tool also includes a pin including a shaft having a first side and a second side. The first side of the shaft is disposed at least adjacent the opening of the core ring. The pin further includes a second radial engagement component configured to engage with the first radial engagement component of the core ring. The second side of the shaft extends axially outwardly from the second end of the core ring. The tool also includes a sleeve connected to the core ring. The first side of the shaft of the pin is slidable with respect to the sleeve. At least a portion of the sleeve extends axially outwardly from the first side of the core ring.

The one or more embodiments also provide for a device. The device includes a reciprocating pump including a pinion shaft. The device also includes a core ring including a first end and a second end disposed opposite the first end. An opening is defined through the first end and the second end. The core ring includes a first radial engagement component. The device also includes a pin including a shaft having a first side and a second side. The first side of the shaft is disposed through the opening of the core ring. The pin further includes a second radial engagement component configured to engage with the first radial engagement component. The second side of the shaft extends axially outwardly from the core ring. The second side of the shaft of the pin is connected to the pinion shaft. The device also includes a sleeve connected to the first end of the core ring. The first side of the shaft of the pin is disposed at least partially inside the sleeve. The first side of the shaft of the pin is axially slidable inside the sleeve.

The one or more embodiments also includes a method of using a device. With respect to the method, the device includes a reciprocating pump including a pinion shaft. The device also includes a core ring including a first end and a second end disposed opposite the first end. An opening is defined through the first end and the second end. The core ring includes a first radial engagement component. A pin including a shaft having a first side and a second side. The first side of the shaft is disposed through the opening of the core ring. The pin further includes a second radial engagement component configured to engage with the first radial engagement component. The second side of the shaft extends axially outwardly from the core ring. The device also includes a sleeve connected to the first end of the core ring. The first side of the shaft of the pin is disposed at least partially inside the sleeve. The first side of the shaft of the pin is axially slidable inside the sleeve. The method includes pressing the sleeve axially towards the pin until the first radial engagement component engages the second radial engagement component. The method also includes turning the sleeve radially. Turning the sleeve radially also radially turns the core ring, the pin, and the pinion shaft of the reciprocating pump.

Other aspects will be apparent from the following description and the appended claims.

BRIEF DESCRIPTION OF DRAWINGS

Like elements in the various figures are denoted by like reference numerals for consistency.

DETAILED DESCRIPTION

In general, the one or more embodiments are directed to a tool used for turning or barring a machine, such as but not limited to a reciprocating pump. As used herein, the term "tool," when used alone, refers to the turning or barring tool as shown in FIG. 1 through FIG. 6 or as otherwise described herein. The tool described herein is useable to perform a turning or barring operation of a workpiece. As used herein, the term "workpiece" refers to any device, or sub-component of a device, for which the tool may be used to perform a turning or barring operation of the device or the sub-component of the device.

The tool of the one or more embodiments may be in an engaged state or a disengaged state. In the disengaged state, certain sub-components (described below) are permitted to rotate freely with the workpiece. In the engaged state, substantially all components of the tool rotate with the workpiece. Thus, in the engaged state, a machine or a technician may turn the tool and thereby turn the workpiece. However, in the disengaged state, the non-rotating components of the tool may extend outwardly from the device without urging the rotation of objects external to the machine or device. Similarly, in the disengaged state, the non-rotating components of the tool may be connected to other devices without urging the other devices to rotate.

For example, the tool may be coupled directly to the pinion center of a driveshaft and allow the user the manually rotate a machine, such as a reciprocating pump. The tool couple allows the user to connect a large socket to the center of the shaft, press and interlock the two halves, and rotate the pump to a desired degree.

Because the tool has both an engaged and a disengaged state, the tool of the one or more embodiments may be covered and then be made accessible from a location external to the machine. A technician or machine then may force the tool into an engaged state and turn the tool in order to perform a turning or barring operation on the machine. Thus, the one or more embodiments provide for increased safety, security, precision, and convenience during a turning or barring operation, relative to disassembly part of the machine and then using an external tool to turn the machine.

Stated differently, the tool of the one or more embodiments allows an end user to mechanically rotate the pump by a desired degree without the need to use unorthodox tooling such as large bars and wrenches. For example, the tool reduces the threat of sheering or damaging a central grease zerk of the driveshaft of a reciprocating pump. The tool is also useful in machines that have a tight means of access to the input side of a driveshaft. Because the tool may be accessed and used without disassembling any part of the connected machine, a turning or barring operation may be performed in a more confined space relative to the space required when using other tools.

Figure 1:
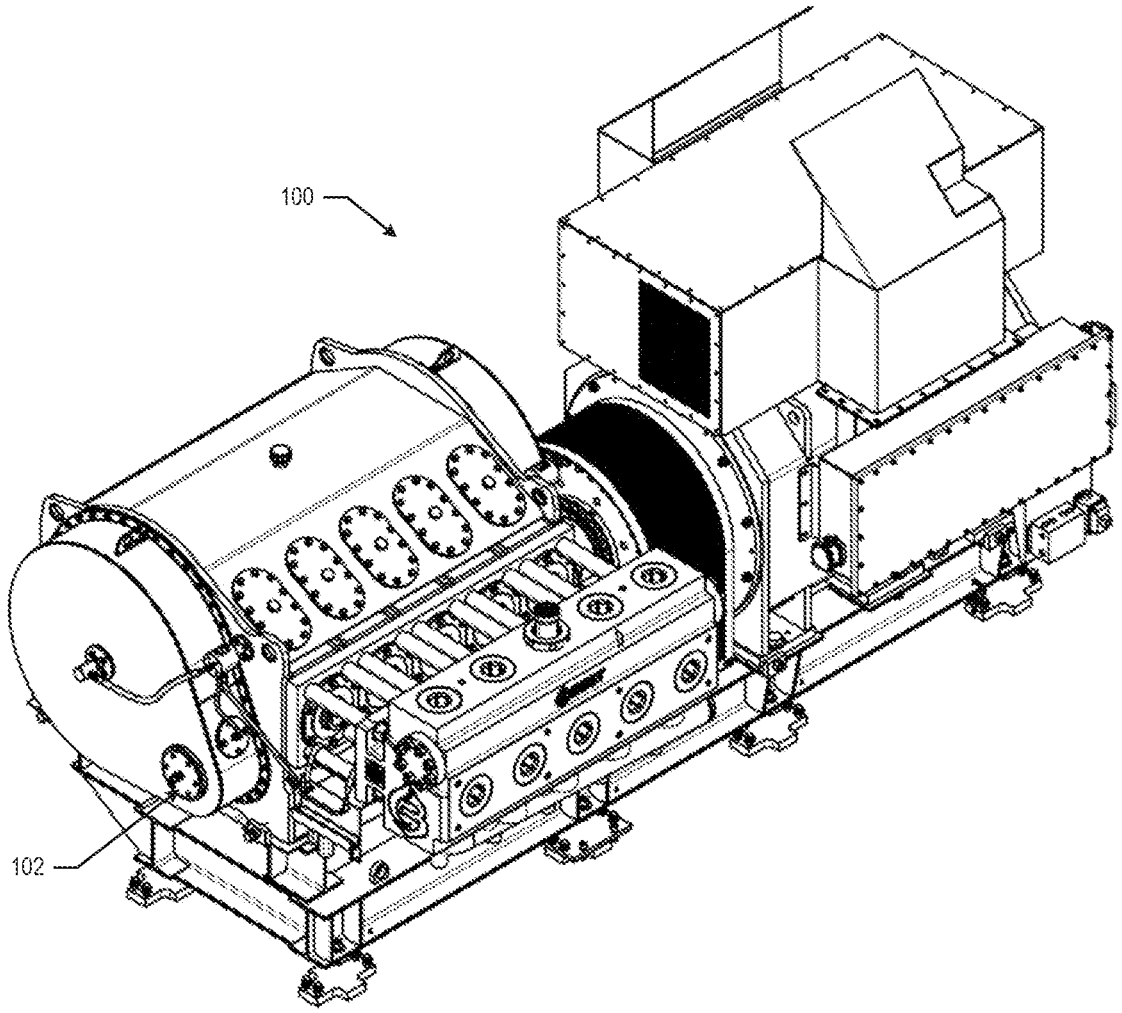
FIG. 1 shows a reciprocating pump, in accordance with one or more embodiments.

Attention is now turned to the figures. FIG. 1 shows a reciprocating pump, in accordance with one or more embodiments. The reciprocating pump (100) may be used in natural resources exploration and production. However, the reciprocating pump (100) may be replaced with any number of different machines which include one or more parts that rotate. In other words, the tool of the one or more embodiments may be useful in many different machines which have rotating components, other than the reciprocating pump (100) shown in FIG. 1.

The reciprocating pump (100) includes a tool (102). Thus, the tool (102) may be used in a turning or barring operation with respect to the reciprocating pump (100) or some other machine. However, the tool (102) may have other applications in other types of machines where it is advantageous to engage and disengage with a rotating component of a machine. The details of the tool (102) are shown and described with respect to FIG. 2 through FIG. 7.

Figure 2:
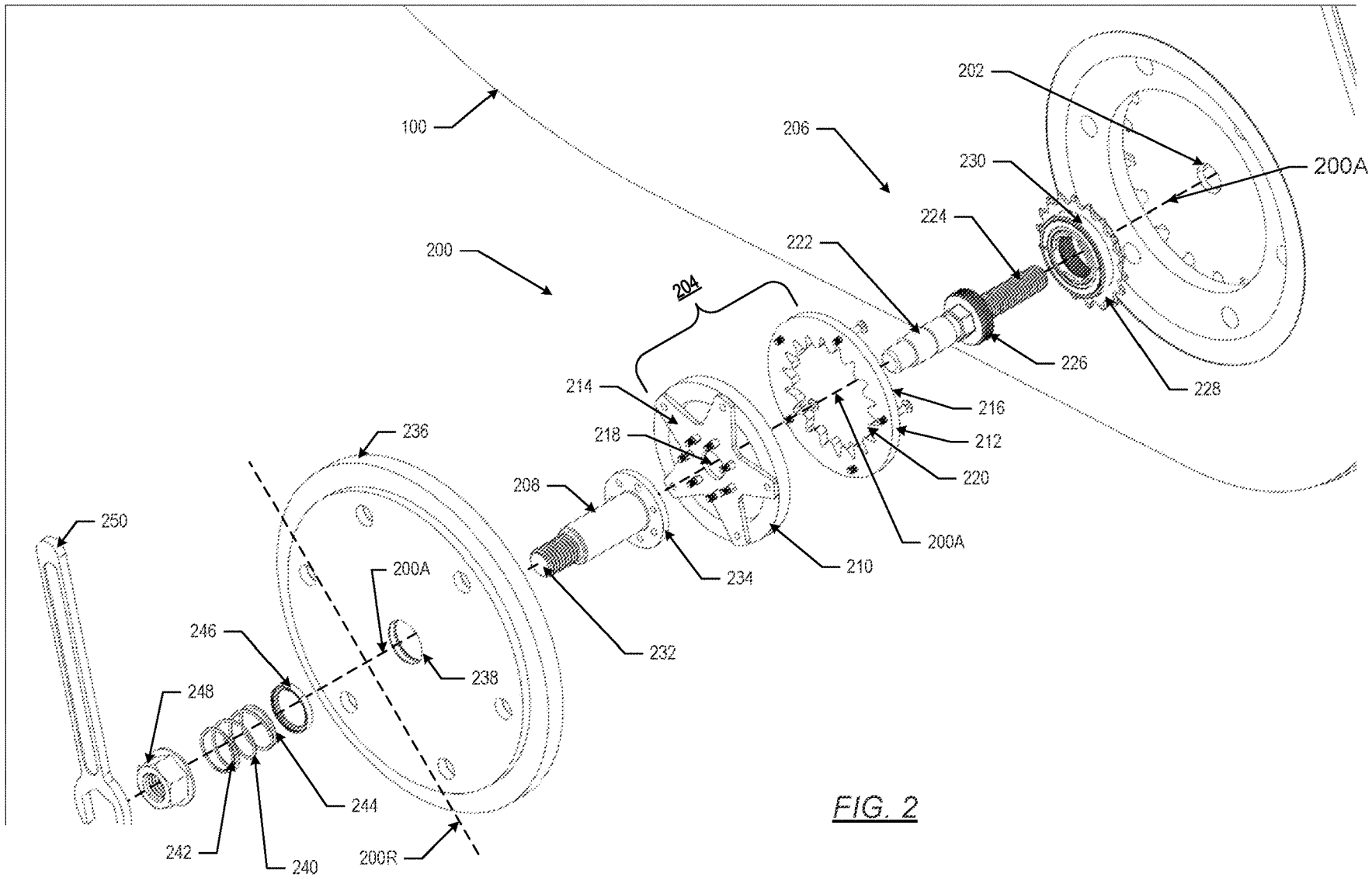
FIG. 2 shows a tool for the reciprocating pump shown in FIG. 1, in accordance with one or more embodiments.

FIG. 2 shows a tool for the reciprocating pump shown in FIG. 1, in accordance with one or more embodiments. The tool (200) is shown in an exploded form in order to identify sub-components of the tool (200). For context, FIG. 2 also shows part of the reciprocating pump (100) of FIG. 1. The reciprocating pump (100) includes a rotating mechanism (202) with which the tool (200) may engage. The rotating mechanism (202) is a rotating component of the reciprocating pump (100). For example, the rotating mechanism (202) may be a pinion shaft connected to the reciprocating pump (100), or may be some other workpiece which is configured to rotate.

When describing the tool (200), reference is made to the terms "radial" or "radially," as well as "axial" or "axially." The term "axial" or "axially" refers to a distance along some axis that is parallel to a longitudinal axis (200A) of the tool (200). A component or sub-component may be located axially with respect to some other component or sub-component, but not aligned along the same axis. For example, an outside radial edge of the sleeve (208) (defined below) may be located an axial distance from the second side (224) of the pin (206) (both defined below), but not disposed along the same longitudinal axis (200A). Stated differently, an "axial" relationship between two components does not necessarily connotate that the two components are coaxial about the same axis, such as the longitudinal axis (200A).

The terms "radial" or "radially" refer to a direction along a line that is parallel to a radial axis (200R) defined as perpendicular to the longitudinal axis (200A). The term "radially inwardly" therefore means pointing along a distance that extends at least partially along the radial axis (200R) towards the longitudinal axis (200A). Similarly, the term "radially outwardly" means pointing along a distance that extends at least partially along the radial axis (200R) away from the longitudinal axis (200A). Two components may have a radial relationship with each other, but not be located along the same radial axis. For example, the middle section (226) (defined below) may extend radially outwardly from the pin (206) (defined below), but not along the same radial axis the outside edge of the sleeve (208) (defined below) extends from a center of the sleeve (208). Stated differently, a "radial" relationship between two components does not necessarily connotate that the two components are coaxial about the same axis, such as the radial axis (200R).

The tool (200) may include a number of different components, some of which are optional. However, the tool (200) includes at least a core ring (204), a pin (206), and a sleeve (208). The core ring (204), the pin (206), and the sleeve (208) may be concentric, but need not be concentric in some embodiments.

Figure 3:
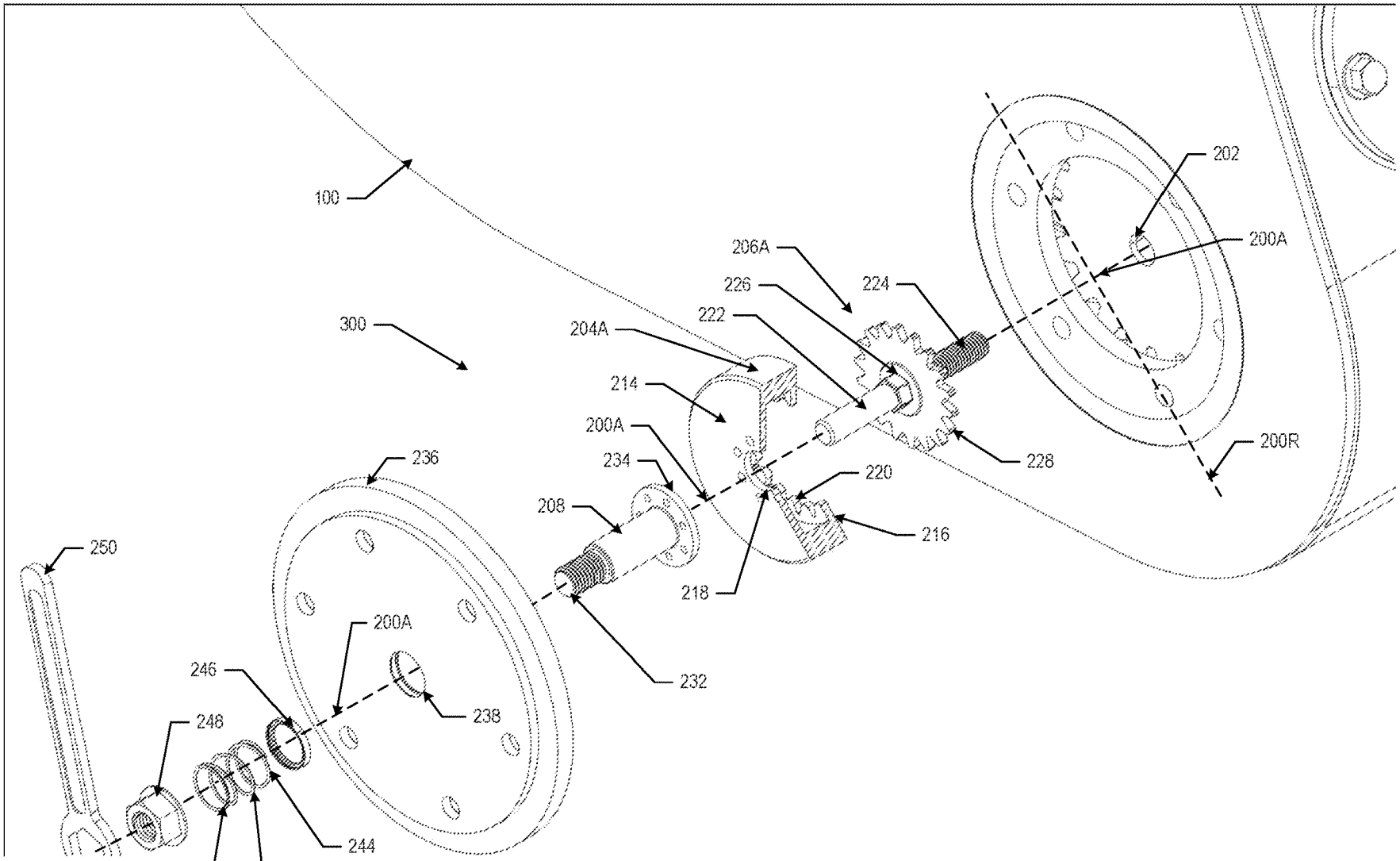
FIG. 3 shows another tool for the reciprocating pump shown in FIG. 1, in accordance with one or more embodiments.

The sizes, shapes, and arrangements of the core ring (204), the pin (206), and the sleeve (208) may vary, such as for example as shown in the variation shown in FIG. 2 and FIG. 3. Similarly, each of the core ring (204), the pin (206), and the sleeve (208) may include sub-components. For example, the core ring (204) may include a main ring (210) connected to a gear ring (212).

The core ring (204) includes a first end (214) and a second end (216) opposite the first end. The sleeve (208) is connected to the first end (214) of the core ring (204). The core ring (204) includes an opening (218) defined through the first end (214) and second end (216).

The core ring (204) includes a first radial engagement component (220) that extends radially inwardly. The first radial engagement component (220) is a portion of the core ring (204) that manually engages with a second radial engagement component (220) in order to cause a rotation of the pin (206). Examples of the first radial engagement component (220) include gear teeth, tabs, hooks, snaps, fasteners, or other objects for connecting one component to another.

In the example of FIG. 2, the first radial engagement component (220) is part of the gear ring (212). The gear ring (212) is a sub component of the core ring (204) in the example of FIG. 2. The first radial engagement component (220) is radially inwardly pointed gear teeth in the example of FIG. 2.

The pin (206) may be characterized as a shaft that may have different sides, sections, and sub-areas. For example, the pin (206) includes a first side (222), a second side (224), and a middle section (226).

The first side (222) of the pin (206) is disposed of at least adjacent to the opening (218) of the core ring (204). The term "adjacent" means that the pin (206) remains aligned with and within a pre-selected distance from the opening (218) nearer to the second end (216) of the core ring (204). However, the first side (222) may also be disposed of through the opening (218) of the core ring (204) and past the first end (214) of the core ring (204).

In use, as described below, the first side (222) of the pin (206) is slidable with respect to the sleeve (208). In particular, the first side (222) of the pin (206) is inwardly and outwardly slidable through the opening (218) and into the sleeve (208). For example, in an engaged relationship, defined further below, the first side (222) of the pin (206) is disposed through the opening (218) and into the sleeve (208). However, in a disengaged relationship, defined further below, the first side (222) of the pin (206) may be, but is not required to be, outside of the opening (218) nearer to the second end (216) of the core ring (204). Nevertheless, the first side (222) remains in alignment with the opening (218) and within the pre-selected distance from the opening (218) nearer to the second end (216) of the core ring (204).

The first side (222) may be sized and dimensioned to fit into an interior space defined within the sleeve (208). Thus, for example, flanges or other shapes may be defined in the first side (222) that permit the first side (222) to engage with corresponding flanges or shapes inside the sleeve (208). However, the first side (222) may be configured to rotate freely inside the sleeve (208) (e.g., the outside edges of the first side (222) might not connect with the inside walls of the sleeve (208)).

The pin (206) further is attached to a second radial engagement component (228). Although not shown in FIG. 2, the pin (206) may include the second radial engagement component (220) (see FIG. 3, for example).

In the example of FIG. 2, the second radial engagement component (228) is part of a free wheel (230), which is connected to the shaft of the pin (206). In the example of FIG. 1, the free wheel (230) is connected to the middle section (226) of the pin (206). Thus, in this example, the second side (224) of the shaft of the pin (206) extends axially through the free wheel (230). The free wheel (230) may be removably connected to the pin (206), fixedly connected to the pin (206), or may be integrally formed with the pin (206). The free wheel (230) may take other forms, such as shown in FIG. 3.

The second radial engagement component (228) of the pin (206) extends radially outwardly. The second radial engagement component (228) may be radially outwardly pointed gear teeth, as shown in FIG. 1. However, the second radial engagement component (228) may also be tabs, hooks, snaps, fasteners, or other objects for connecting one component to another. Nevertheless, the second radial engagement component (228) is configured to engage with the first radial engagement component (220) of the core ring (204). In the example of FIG. 1, the gear teeth of the second radial engagement component (228) are configured to engage with the gear teeth of the first radial engagement component (220) of the gear ring (212), which in turn is part of the core ring (204).

Returning to the pin (206), the second side (224) of the shaft of the pin (206) extends axially outwardly from the second end (216) of the core ring (204). The term "axially outwardly" means that the second side (224) extends away from the second end (216) of the core ring (204).

The second side (224) of the pin (206) may be fitted with threads, as shown in FIG. 2. The threads may permit the second side (224) of the pin (206) to be removably attached to the rotating mechanism (202) in a manner that will cause the second side (224) of the pin (206) to rotate as the rotating mechanism (202) rotates. Similarly, if the second side (224) of the pin (206) is rotated, then the rotating mechanism (202) will be likewise rotated. Although threads are shown on the second side (224) of the pin (206) in FIG. 1, other means for fixing the pin (206) to the rotating mechanism (202) are possible. For example, a radially expandable pin disposed of in the second side (224) may connect to slots inside the rotating mechanism (202). Thus, the one or more embodiments are not necessarily limited to the arrangement shown in FIG. 1.

Attention is now turned to the sleeve (208). The sleeve (208) includes a sleeve first side (232) and a sleeve second side (234). The sleeve second side (234) is connected to the first end (214) of the core ring (204). The sleeve first side (232) extends axially outwardly from the first end (214) of the core ring (204).

The sleeve (208) is at least partially hollow along a portion of the sleeve (208) nearer to the sleeve second side (234). The hollow portion of the sleeve (208) is sized and dimensioned to receive the first side (222) of the pin (206). Thus, the first side (222) of the pin (206) may be disposed of at least partially inside the sleeve (208) and axially slidable inside the sleeve (208). Optionally, the sleeve first side (232) may include a threaded portion, as shown in FIG. 1. The threaded portion of the sleeve first side (232) may or may not be hollow.

Optionally, the tool (200) may include a cover plate (236). The cover plate (236) may be configured to cover the tool (200) when the tool (200) is disposed of in the rotating mechanism (202) of the reciprocating pump (100). At least part of the sleeve (208) extends out of a hole (238) defined in the cover plate (236). Thus, in use, the sleeve first side (232) may extend out of the cover plate (236) when the cover plate (236) is connected to the reciprocating pump (100) and covers the rest of the tool (200).

Optionally, a spring (240) may be part of the tool (200). The spring (240) has a first face (242) and a second face (244) opposite the first face, relative to an axial length of the spring (240). The first face (242) faces axially outwardly, away from the sleeve (208). The second face (244) faces axially inwardly, towards the sleeve (208). The spring (240) may be disposed against a washer (246) that fits over the sleeve (208). Nevertheless, the second face (244) of the spring (240) is either directly or indirectly connected to or rests against some part of the sleeve (208).

The first face (242) of the spring (240), in turn, is disposed against a nut (248) or some other device that is slidably connectable to the sleeve (208). The nut (248) may be adjusted (e.g., turned) by an external implement (250), and thereby axial movement of the nut (248) along the sleeve first side (232) of the sleeve (208). The external implement (250) may be a wrench, as shown, but may be any other suitable implement for adjusting a nut or other device connected to the sleeve (208).

Adjusting the nut (248) with the external implement (250) urges the spring (240) towards a compressed state or a decompressed state. As the spring (240) compresses, the sleeve (208) is urged towards the core ring (204). In turn, the core ring (204) moves downwardly over the pin (206). Accordingly, the second face (244) of the spring (240) is connected to the sleeve (208) in a manner that urges the sleeve (208) towards the pin (206) when the spring (240) is compressed. When the spring (240) is thusly compressed, the first side (222) of the pin (206) enters the hollow portion of the sleeve (208) and the second radial engagement component (228) comes into engagement with the first radial engagement component (220) of the core ring (204).

Once the first radial engagement component (220) is engaged with the second radial engagement component (228), the external implement (250) may be used to turn the sleeve (208). Turning the sleeve (208) turns the core ring (204). Turning the core ring (204) while the engagement components are engaged forces the second side (224) of the pin (206) to rotate. Rotation of the second side (224) of the pin (206) in turn forces rotation of the rotating mechanism (202).

In summary, the second radial engagement component (228) is engaged with the first radial engagement component (220) when the first side (222) of the shaft of the pin (206) is in a first position with respect to the sleeve (208). The first position is that the first side (222) of the shaft of the pin (206) is inside the sleeve (208). The second radial engagement component (228) is disengaged from the first radial engagement component (220) when the first side (222) of the shaft of the pin (206) is in a second position with respect to the sleeve. The second position is that the first side (222) of the shaft of the pin (206) is either outside the sleeve (208) or is disposed inside the sleeve (208) but able to rotate freely within the sleeve (208).

In either case, more of the first side (222) of the shaft of the pin (206) is engaged with the sleeve (208) in the first position relative to the second position. In the first position, the core ring (204), the sleeve (208), the pin (206), and the rotating mechanism (202) rotate together. In the second position, the core ring (204) and the sleeve (208) are configured to permit the first side (222) of the shaft of the pin (206) to rotate freely. Further, the second side (224) of the shaft of the pin (206) is rotatable with the rotating mechanism (202).

In this manner, the rotating mechanism (202) of the reciprocating pump (100) may be turned by a desired amount. The turning operation is known as a turning operation or a barring operation.

Thereafter, the external implement (250) may be used to loosen the nut (248) and thereby force the spring (240) to decompress. As the spring (240) decompresses, the sleeve (208) is urged axially outwardly away from the pin (206). The first radial engagement component (220) then disengages from the second radial engagement component (228). As a result, even if the rotating mechanism (202) rotates and forces the second side (224) of the pin (206) to rotate with the rotating mechanism (202), the first side (222) at most rotates inside the sleeve (208) or rotates while outside of the sleeve (208) altogether. As a result, the sleeve (208) and the core ring (204) do not rotate as the rotating mechanism (202) and the pin (206) rotate.

The arrangement of the tool (200) is useful because the cover plate (236) need not be removed in order to perform a turning operation or a barring operation. Furthermore, no components inside the reciprocating pump (100) need to be disassembled. Instead, the cover plate (236) may remain in place while the spring (240) is compressed or decompressed to engage or disengage the core ring (204) with the pin (206) as desired.

FIG. 3 shows another tool for the reciprocating pump shown in FIG. 1, in accordance with one or more embodiments. The tool (300) is shown in FIG. 3 is a variation of the tool (200) shown in FIG. 2. The tool (300) of FIG. 3 shares many common components and properties as the tool (200) of FIG. 2. Thus, FIG. 2 and FIG. 3 share some common reference numerals, which refer to similar components having similar definitions and functions. The tool (300) of FIG. 3 is explained in terms of the differences between the tool (300) and the tool (200) of FIG. 2.

For example, the core ring (204) of FIG. 2 includes a main ring (210) connected to a gear ring (212). However, the modified core ring (204A) of FIG. 3 is a single body. The first radial engagement component (220) of the modified core ring (204A) is formed in a flange directed radially inwardly from the second end (216) of the modified core ring (204A).

In another example, tool (200) of FIG. 2 includes a free wheel (230). However, the free wheel (230) has been eliminated from the modified pin (206A) of FIG. 3. Instead, the second radial engagement component (228) is connected to the middle section (226) of the modified pin (206A). The second radial engagement component (228) may be integrally formed with the shaft of the modified pin (206A) in some embodiments.

The variations shown in FIG. 3 show that the components of the tool (200) described with respect to FIG. 2 may be varied in shape, size, and design, yet still provide for the desired functionality and interoperability described above. Accordingly, the one or more embodiments are not necessarily limited to the examples shown in either FIG. 2 or FIG. 3.

Figure 4:
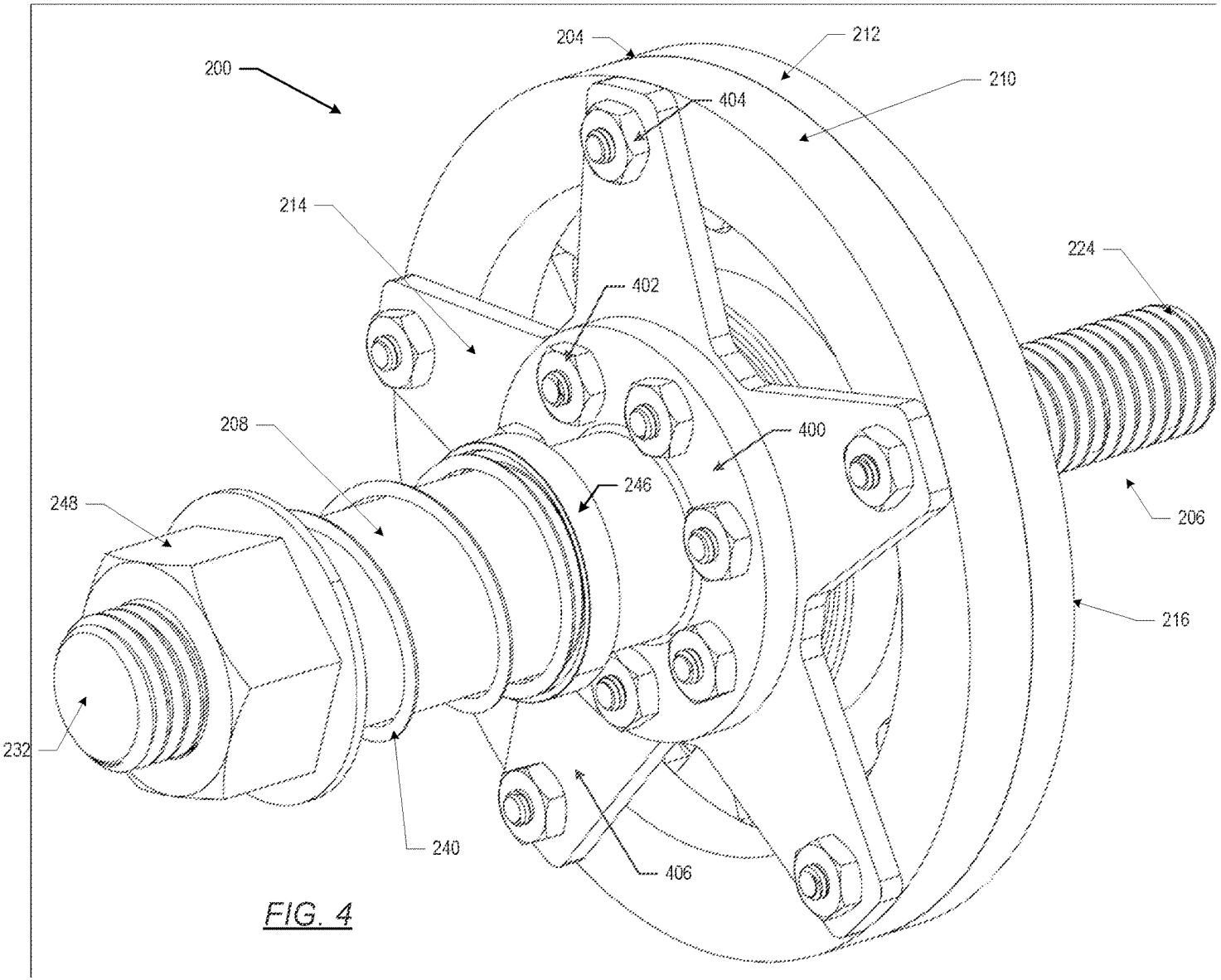
FIG. 4, FIG. 5, and FIG. 6 show different views of the tool shown in FIG. 2, in accordance with one or more embodiments.
Figure 5:
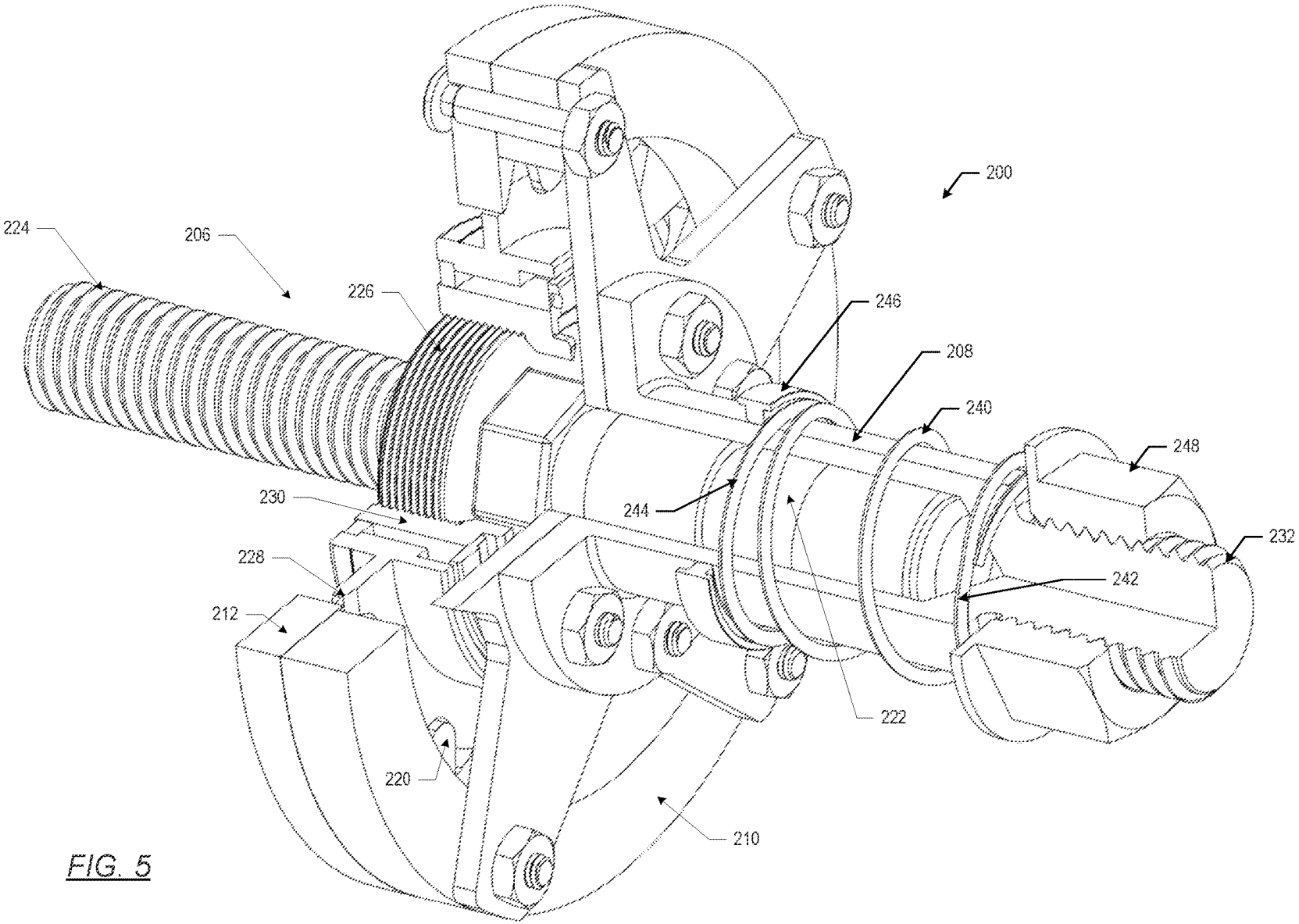
Figure 6:
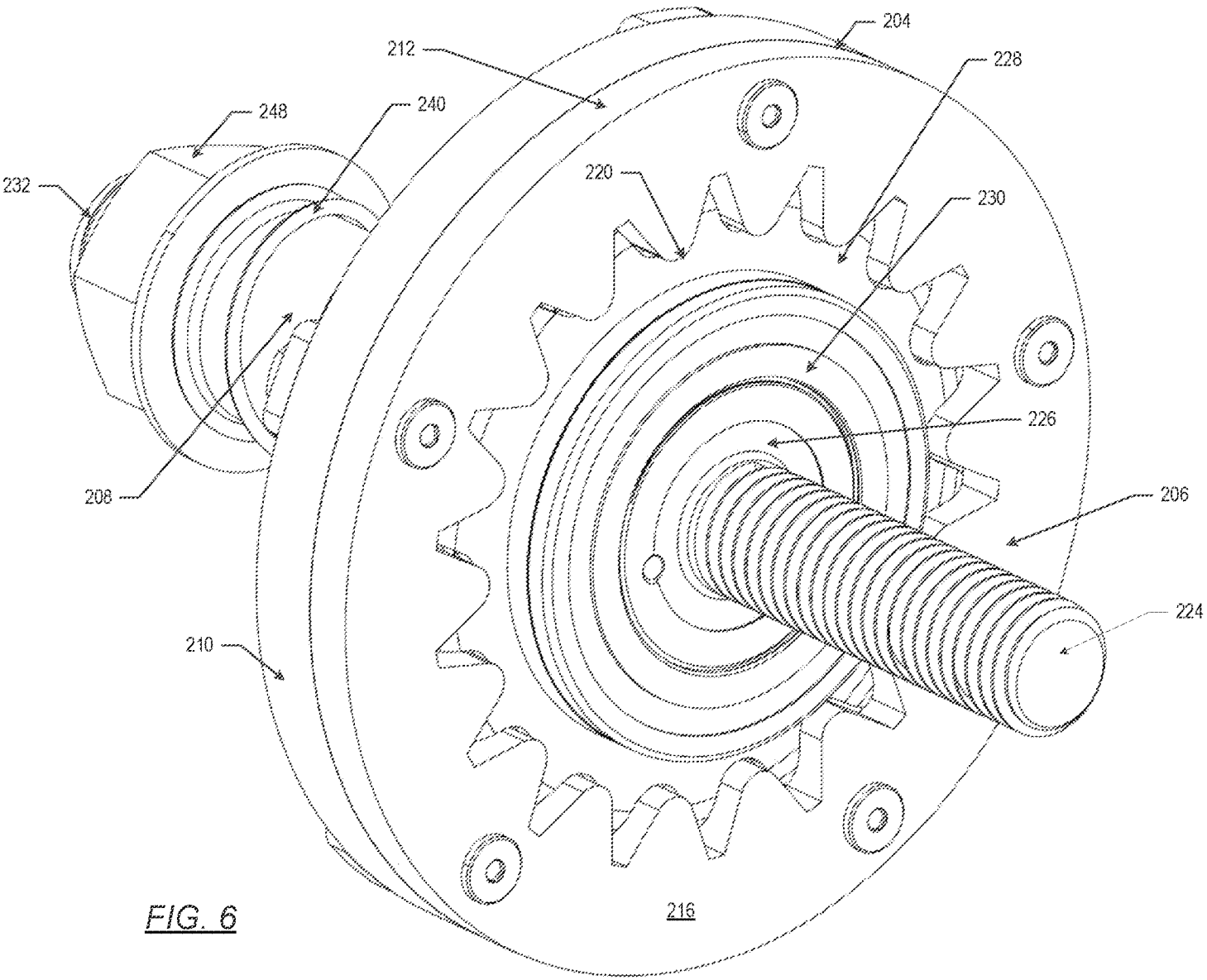

FIG. 4, FIG. 5, and FIG. 6 show different views of the turning or barring tool shown in FIG. 2, in accordance with one or more embodiments. In particular, FIG. 4 through FIG. 6 show different perspectives of the tool when assembled. Thus, FIG. 2 and FIG. 4 through FIG. 6 share common reference numerals that refer to similar objects having similar relationships and functions.

FIG. 4 shows a perspective view of the tool (200) oriented in a similar manner as the tool (200) shown in FIG. 2, but with the subcomponents assembled together. Thus, the tool (200) shown in FIG. 4 includes a core ring (204), including the main ring (210) and the gear ring (212), the first end (214) of the core ring (204), and the second end (216) of the core ring (204). The sleeve (208) is shown extending from the first end (214) of the core ring (204). The second side (224) of the pin (206) extends from the second end (216) of the core ring (204). The nut (248) is secured to the sleeve first side (232). The spring (240) is disposed of between the nut (248) and the washer (246), which rests against an inset formed in the outer diameter of the sleeve (208).

FIG. 4 also shows that the sleeve (208) includes a flange (400) that is connected to the first end (214) of the core ring (204). While the flange (400) may be optional in some embodiments, the flange (400) may provide additional space for fasteners, such as fastener (402), to connect the sleeve (208) to the core ring (204). Still, other fasteners, such as fastener (404), may be used to connect the main ring (210) to the gear ring (212) of the core ring (204) to each other via a star (406).

FIG. 5 shows another perspective view of the tool (200), with a reversed orientation relative to the orientation of the tool (200) shown in FIG. 2 (i.e., shown as flipped end-to-end along the longitudinal axis (200A)). The core ring (204) includes a cut-out to show additional components that would otherwise be hidden from view.

Thus, FIG. 5 shows the pin (206), with the second side (224) of the pin (206) extending axially away from the core ring (204) and the first side (222) of the pin (206) extending into hollow space defined inside the sleeve (208). The middle section (226) of the pin (206) includes threads that engage with the free wheel (230) in order to secure the free wheel (230) to the pin (206).

The tool (200) is shown in a compressed state. Thus, the second radial engagement component (228) of the free wheel (230) is engaged with the first radial engagement component (220) of the gear ring (212) portion of the core ring (204). The tool (200) was compressed by turning the nut (248), which pushed on the first face (242) of the spring (240). In turn, the spring (240) was urged into a compressed state. In the compressed state, the second face (244) of the spring (240) pushed against the washer (246), which pressed the sleeve (208) towards the first side (222) of the pin (206) until the first side (222) of the pin (206) was fully engaged inside the sleeve (208).

FIG. 6 shows another perspective view of the tool (200), with a reversed orientation relative to the orientation of the tool (200) shown in FIG. 2 (i.e., shown as flipped end-to-end along the longitudinal axis (200A)). The tool (200) is in a compressed state, as shown in FIG. 5. However, the perspective angle of FIG. 6 is changed relative to the perspective angle shown in FIG. 5.

Again, the nut (248) has been tightened on the sleeve first side (232) in order to compress the spring (240). By compressing the spring (240), the sleeve (208) and core ring (204) are urged to move towards the free wheel (230). Thus, the first side (222) (see FIG. 5) of the pin (206) is disposed of inside the sleeve (208). The second side (224) of the pin (206) extends axially outwardly from the second end (216) of the main ring (210) portion of the core ring (204).

The middle section (226) of the pin (206) is also shown engaged with the free wheel (230). Additionally, the second radial engagement component (228) of the free wheel (230) is engaged with the first radial engagement component (220) of the gear ring (212) portion of the core ring (204).

Figure 7:
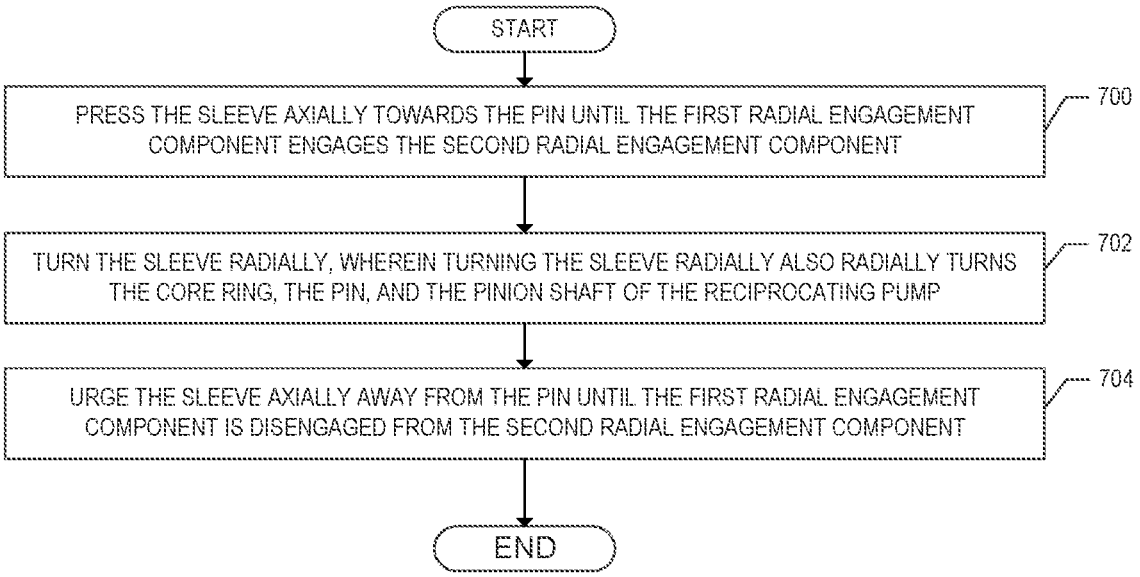
FIG. 7 shows a flowchart of a method, in accordance with one or more embodiments.

FIG. 7 shows a flowchart of a method, in accordance with one or more embodiments. The method of FIG. 7 may be characterized as a method of using a device which includes a tool and a reciprocating pump. The tool may be the tool (200) shown in FIG. 2 or the tool (300) shown in FIG. 3. The reciprocating pump may be the reciprocating pump (100) shown in FIG. 1. Thus, the method of FIG. 7 uses components described with respect to FIG. 1 through FIG. 3.

The device used in the method of FIG. 7 may be characterized as follows. The device includes a reciprocating pump including a pinion shaft or some other workpiece. A core ring including a first end and a second end is disposed opposite the first end. An opening is defined through the first end and the second end. The core ring includes a first radial engagement component. A pin includes a shaft having a first side and a second side. The first side of the shaft is disposed of through the opening of the core ring. The pin further includes a second radial engagement component configured to engage with the first radial engagement component. The second side of the shaft extends axially outwardly from the core ring. A sleeve connected to the first end of the core ring. The first side of the shaft of the pin is disposed of at least partially inside the sleeve. The first side of the shaft of the pin is axially slidable inside the sleeve.

Step 700 includes pressing the sleeve axially towards the pin until the first radial engagement component engages the second radial engagement component. The sleeve may be pressed axially towards the pin by turning a nut which compresses a spring that imparts a force against the sleeve. However, the sleeve may also be pressed manually. Alternatively, the sleeve may be pushed in and then retained in a locked position by locking the sleeve to the core ring.

Step 702 includes turning the sleeve radially, wherein turning the sleeve radially also radially turns the core ring, the pin, and the pinion shaft of the reciprocating pump. Because the two radial engagement components have been engaged, the turning of any part of the tool will cause the entire tool to rotate. As the tool rotates, the pinion shaft of the reciprocating pump will also rotate. The degree of rotation of the pinion shaft of the reciprocating pump may be controlled by controlling the degree of rotation applied to the sleeve first side of the tool.

In an embodiment, the method of FIG. 7 may terminate after step 702. However, the method of FIG. 7 may also include step 704. Step 704 includes urging the sleeve axially away from the pin until the first radial engagement component is disengaged from the second radial engagement component. Urging the sleeve axially way may be performed by loosening a nut at the sleeve first side of the tool, which decompresses a spring and causes the sleeve to be urged axially away from the pin and the free wheel. Urging the sleeve axially away may also include manually pulling the sleeve axially outwardly. Urging the sleeve axially away may also include unlocking the sleeve from the core ring and then pulling the sleeve axially outwardly.

In any case, when the first radial engagement component and the second radial engagement component are disengaged, the first side of the pin rotates freely within the sleeve as the pinion shaft rotates the pin. Thus, when the reciprocating pump is operating and the pinon shaft is rotating, the pin will rotate. However, because the two radial engagement components are not engaged, the sleeve and the core ring of the tool will not turn. Thus, no moving parts are exposed outside the reciprocating pump.

The method of FIG. 7 may be varied. For example, as indicated above, the device also may include a spring including a first face and a second face opposite the first face. The second face is connected to the sleeve to urge the sleeve towards the pin. The device also may include a nut disposed around the sleeve. The first face of the spring is disposed against the nut.

In this case, as indicated above, the method of FIG. 7 may include adjusting the nut axially towards the sleeve to compress the spring to urge the sleeve and the core ring axially inwardly until the first radial engagement component engages with the second radial engagement component. Alternatively, the method of FIG. 7 may include adjusting the nut axially away from the sleeve to decompress the spring to urge the sleeve and the core ring axially outwardly until the first radial engagement component disengages from the second radial engagement component.

Still, other variations are possible. For example, the reciprocating pump may be replaced by some other machine that includes a rotating component that may be connected to the pin of the tool. Thus, the one or more embodiments are not necessarily limited to the example method of FIG. 7.

Attention is now turned to an example of a use of the tool of the one or more embodiments described herein. A technician has been assigned the task of turning or barring a reciprocating pump that includes a workpiece (e.g., a pinion shaft) to which the tool is attached. The technician applies an implement to a nut connected to a sleeve that extends through a hole in a cover plate attached to the reciprocating pump. The technician turns the nut in order to compress the spring, and thereby force sleeve and core ring towards the pin. In turn, this action causes the pin to enter the sleeve and the first radial engagement component of the core ring to engage with the second radial engagement component connected to the pin. Then, the technician turns the sleeve first side, which causes all of the core ring, pin, and workpiece to turn the same number of radians as the technician turned the sleeve. When the technician is satisfied that the workpiece has been turned to a desired degree, the technician loosens the nut. Loosening the nut causes the spring to relax, which in turn causes the sleeve to slide axially outwardly away from the pin. The two radial engagement components go out of engagement, thereby once again permitting the pin and workpiece to turn freely without turning the core ring and the sleeve. Likewise, any further rotation of the sleeve and core ring will not turn the pin or the workpiece. During the entire turning operation the technician need not remove the cover plate, thereby increasing the speed of the turning operation and decreasing the likelihood of damaging the tool or the reciprocating pump.

In the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, or is an "inclusive or" and, as such includes "and." Further, items joined by an or may include any combination of the items with any number of each item unless expressly stated otherwise.

The term "about," when used with respect to a physical property that may be measured, refers to an engineering tolerance anticipated or determined by an engineer or manufacturing technician of ordinary skill in the art. The exact quantified degree of an engineering tolerance depends on the product being produced and the technical property being measured. For a non-limiting example, two angles may be "about congruent" if the values of the two angles are within ten percent of each other. However, if an engineer determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A was, at least at some point, separate from component B, but then was later joined to component B in either a fixed or a removably attached arrangement. In a second meaning, unless otherwise stated, "connected to" means that component A could have been integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process. In other words, the bottom and the wall, in being "connected to" each other, could be separate components that are brought together and joined, or maybe a single piece of material that is bent at an angle so that the bottom panel and the wall panel are identifiable parts of the single piece of material.

In the above description, numerous specific details are set forth in order to provide a more thorough understanding. However, it will be apparent to one of ordinary skill in the art that the invention may be practiced without these specific details. In other instances, well-known features have not been described in detail to avoid unnecessarily complicating the description. Further, other embodiments not explicitly described above can be devised which do not depart from the scope as disclosed herein. Accordingly, the scope should be limited only by the attached claims.

What is claimed is:

1. A tool comprising:

a core ring comprising a first end and a second end disposed opposite the first end,
wherein:
an opening is defined through the first end and the second end, and
the core ring comprises a first radial engagement component;

a pin comprising a shaft having a first side and a second side, wherein:
the first side of the shaft is disposed at least adjacent the opening of the core ring,
the pin further comprises a second radial engagement component configured to engage with the first radial engagement component of the core ring, and
the second side of the shaft extends axially outwardly from the second end of the core ring;

a sleeve connected to the core ring, wherein:
the first side of the shaft of the pin is slidable with respect to the sleeve, and
at least a portion of the sleeve extends axially outwardly from the first side of the core ring; and a spring comprising a first face and a second face opposite the first face, wherein:
the sleeve is connected to the first end of the core ring and extends axially outwardly from the first end of the core ring, and
the second face of the spring is connected to the sleeve to urge the sleeve towards the pin.

2. The tool of claim 1, wherein:
the first side of the shaft of the pin is disposed through the opening of the core ring and past the first end of the core ring,
the sleeve is connected to the first end of the core ring,
the first side of the shaft of the pin is disposed at least partially inside the sleeve, and
the first side of the shaft of the pin is axially slidable inside the sleeve.

3. The tool of claim 1, wherein:
the first side of the shaft of the pin is configured to be at least partially disposed inside of the sleeve,
the first side of the shaft of the pin is further disposed through the opening in the core ring and extends axially at least partially into the sleeve, and
the first side of the shaft of the pin is axially slidable inside the sleeve.

4. The tool of claim 1, wherein the core ring further comprises:
a main ring connected to the sleeve; and
a gear ring connected to the main ring, wherein the first radial engagement component extends radially inwardly from the gear ring.

5. The tool of claim 1, wherein the pin further comprises:
a free wheel connected to the shaft of the pin, and further wherein:
the second side of the shaft of the pin extends axially through the free wheel,
the second radial engagement component of the pin extends radially outwardly from the free wheel.

6. The tool of claim 5, wherein the free wheel is removably connected to the pin.

7. The tool of claim 1, wherein:

the second radial engagement component is engaged with the first radial engagement component when the first side of the shaft of the pin is in a first position with respect to the sleeve, the second radial engagement component is disengaged from the first radial engagement component when the first side of the shaft of the pin is in a second position with respect to the sleeve, and more of the first side of the shaft is engaged with the sleeve in the first position relative to the second position.

8. The tool of claim 7, further comprising a rotating mechanism, wherein:

the second side of the shaft is connected to the rotating mechanism, in the first position, the core ring, the sleeve, the pin, and the rotating mechanism rotate together, and in the second position, the core ring and the sleeve are configured to permit the first side of the shaft of the pin to rotate freely, and further the second side of the shaft of the pin is rotatable with the rotating mechanism.

9. The tool of claim 8, further comprising:

a reciprocating pump connected the rotating mechanism.

10. The tool of claim 1, wherein the sleeve, the core ring, and the pin are concentric.

11. The tool of claim 1, further comprising:

a nut slidably connected to the sleeve, wherein:

wherein the first face of the spring is disposed against the nut, and wherein axial movement of the nut along the sleeve urges the spring towards a compressed state or a decompressed state.

12. The tool of claim 1, further comprising:

a cover plate, wherein:

the sleeve is connected to the first end of the core ring and extends axially outwardly from the first end of the core ring, and the sleeve is disposed through a hole in the cover plate.

13. A device comprising:

a reciprocating pump comprising a rotating mechanism;

a core ring comprising a first end and a second end disposed opposite the first end, wherein:

an opening is defined through the first end and the second end, and the core ring comprises a first radial engagement component;

a pin comprising a shaft having a first side and a second side, wherein:

the first side of the shaft is disposed through the opening of the core ring, the pin further comprises a second radial engagement component configured to engage with the first radial engagement component, the second side of the shaft extends axially outwardly from the core ring, and the second side of the shaft of the pin is connected to the rotating mechanism;

a sleeve connected to the first end of the core ring, wherein:

the first side of the shaft of the pin is disposed at least partially inside the sleeve, and the first side of the shaft of the pin is axially slidable inside the sleeve; and a spring comprising a first face and a second face opposite the first face, wherein:

the sleeve is connected to the first end of the core ring and extends axially outwardly from the first end of the core ring, and the second face of the spring is connected to the sleeve to urge the sleeve towards the pin.

14. The device of claim 13, wherein:

the second radial engagement component is engaged with the first radial engagement component when the first side of the shaft of the pin is in a first position inside the sleeve, the second radial engagement component is disengaged from the first radial engagement component when the first side of the shaft of the pin is in a second position inside the sleeve, and more of the first side of the shaft is disposed within the sleeve in the first position relative to the second position.

15. The device of claim 14, wherein:

in the first position, the core ring, the sleeve, the pin, and the rotating mechanism rotate together, and in the second position, the core ring and the sleeve are configured to turn freely around the first side of the shaft of the pin, and further the second side of the shaft of the pin, and the rotating mechanism are rotatable together.

16. A method of using a device, wherein the device comprises:

a reciprocating pump comprising a rotating mechanism;

a core ring comprising a first end and a second end disposed opposite the first end, wherein:

an opening is defined through the first end and the second end, and the core ring comprises a first radial engagement component;

a pin comprising a shaft having a first side and a second side, wherein:

the first side of the shaft is disposed through the opening of the core ring, the pin further comprises a second radial engagement component configured to engage with the first radial engagement component, and the second side of the shaft extends axially outwardly from the core ring; and a sleeve connected to the first end of the core ring, wherein:

the first side of the shaft of the pin is disposed at least partially inside the sleeve, and the first side of the shaft of the pin is axially slidable inside the sleeve;

wherein the method comprises:

pressing the sleeve axially towards the pin until the first radial engagement component engages the second radial engagement component; and turning the sleeve radially, wherein turning the sleeve radially also radially turns the core ring, the pin, and the rotating mechanism of the reciprocating pump.

17. The method of claim 16, further comprising:

urging the sleeve axially away from the pin until the first radial engagement component is disengaged from the second radial engagement component, wherein, when the first radial engagement component and the second radial engagement component are disengaged, the first side of the pin rotates freely within the sleeve as the rotating mechanism rotates the pin.

18. The method of claim 16, wherein the device further comprises:

a spring comprising a first face and a second face opposite the first face, wherein the second face is connected to the sleeve to urge the sleeve towards the pin, and a nut disposed around the sleeve, wherein the first face of the spring is disposed against the nut, and wherein the method further comprises one of:

adjusting the nut axially towards the sleeve to compress the spring to urge the sleeve and the core ring axially inwardly until the first radial engagement component engages with the second radial engagement component; and adjusting the nut axially away from the sleeve to decompress the spring to urge the sleeve and the core ring axially outwardly until the first radial engagement component disengages from the second radial engagement component.

* * * * *